US005794347A

United States Patent [19]

Serpa

[11] Patent Number: 5,794,347

[45] Date of Patent: Aug. 18, 1998

[54] KNIFE/SHEATH LOCKING DEVICE

[76] Inventor: Michael L. Serpa, P.O. Box 2693, Newport Beach, Calif. 92659

[21] Appl. No.: 779,258

[22] Filed: Jan. 3, 1997

[51] Int. Cl.[6] ..... B26B 29/02

[52] U.S. Cl. ..... 30/162; 30/151; 224/232

[58] Field of Search ..... 30/151, 162; 224/232; 24/614, 615, 616, 617, 625

[56] References Cited

U.S. PATENT DOCUMENTS

| | | | |
|---|---|---|---|
| 2,391,574 | 12/1945 | Housinger . | |
| 2,527,710 | 9/1950 | Davidson . | |
| 2,618,057 | 11/1952 | Gibson | 30/151 |
| 2,783,536 | 3/1957 | McQueary | 30/151 |
| 2,901,823 | 9/1959 | Widen . | |
| 3,524,570 | 8/1970 | Seguine . | |
| 4,150,464 | 4/1979 | Tracy . | |
| 4,404,747 | 9/1983 | Collins . | |
| 4,835,863 | 6/1989 | Salandre . | |
| 4,854,044 | 8/1989 | Collins . | |
| 5,067,239 | 11/1991 | Collins . | |
| 5,092,046 | 3/1992 | Collins . | |
| 5,123,167 | 6/1992 | Kelley . | |
| 5,146,684 | 9/1992 | Hagler | 30/162 |
| 5,222,279 | 6/1993 | Frano et al. . | |
| 5,379,520 | 1/1995 | Collins . | |
| 5,507,076 | 4/1996 | Anscher | 24/625 |

*Primary Examiner*—Hwei-Siu Payer

[57] ABSTRACT

A knife/sheath locking assembly for retaining a knife (10) or other tool within a sheath (16). Two flexible arms (18) extend outward from opposite sides of the open end (17) of the sheath (16). The handle (12) of the knife (10) includes two tunnel structures (32) located proximal to the blade (14) and spaced to cooperatively accept the flexible arms (18) of the sheath (16). Latch elements disposed on the flexible arms (18) retain the knife (10) within the sheath (16), and removal of the knife (10) requires the inward urging of the distal ends (22) of the flexible arms (18).

6 Claims, 4 Drawing Sheets

KNIFE/SHEATH LOCKING DEVICE

FIELD OF THE INVENTION

This invention relates to an improved molded device for locking a knife or other tool in a sheath.

BACKGROUND OF THE INVENTION

A variety of mechanical devices have been developed for securely holding a tool, such as a knife, in a sheath in a manner that permits the user to quickly and easily release the knife from the sheath when desired. These features are particularly important for sporting and/or rescue purposes while in water or underwater, such as for use by underwater divers. Underwater divers must be able to remove a knife from a sheath quickly and easily while being assured that, when not in use, the knife will remain securely in the sheath even in extreme conditions.

DISCUSSION OF PRIOR ART

One type of knife and sheath combination holds the knife in place simply by friction between the blade of the knife and the sheath. This combination is not suitable for underwater divers because movements of the diver in the water may inadvertently cause the blade to lose frictional engagement with the sheath.

Other devices include knife and sheath assemblies using spring loaded buttons to hold the knife in place. Such knife and sheath combinations are exemplified by Housinger, U.S. Pat. No. 2,391,574 issued Dec. 25, 1945; Widen, U.S. Pat. No. 2,901,823 issued Sep. 1, 1959; Collins, U.S. Pat. No. 4,404,747 issued Sep. 20, 1983; and Collins, U.S. Pat. No. 4,854,044 issued Aug. 8, 1989. Each of these patents provide locking mechanisms in which spring loaded detents interengage a sheath or similar holder. While such arrangements provide a rapid release locking mechanism, the constructions either involve an assembly of a number of components or involve the use of separate moving parts while in use. These factors complicate the production of these inventions. Additionally, the many parts involved possibly increase the risk of corrosion, wear and tear, or failure while in use.

Collins, U.S. Pat. No. 5,067,239 issued Nov. 26, 1991, provides a laterally sliding lock mechanism on the sheath to hold the knife. Some users, however, may find using a lateral thumb motion difficult or uncomfortable for releasing a knife. Furthermore, the tab arrangement has a substantially one-sided arrangement that might not be suitable for all users.

Two other designs provide knife/sheath locking assemblies that can be integrally molded and are therefore relatively simple to manufacture and assemble. The first, Kelley, U.S. Pat. No. 5,123,167 issued Jun. 23, 1992, provides a flexible arm member offset from the main portion of the handle with a latch component located on the inner surface of the flexible arm. The latch component engages an upper edge of the sheath to hold the knife in place. One disadvantage of this design is that an obstruction, such as seaweed or monofilament line, could snag on the recess defined by the arm member and the main portion of the handle while the knife is in use. Additionally, because a portion of this same recess is exposed while the knife is in the sheath, a foreign object could enter the recess thereby preventing an inward flex of the arm and making withdrawal of the knife difficult.

The second design that can be integrally molded, Collins, U.S. Pat. No. 5,379,520 issued Jan. 10, 1995, provides an integrally molded sheath assembly that includes a lever angled to engage a band circumventing the knife handle. This design creates an exposed gap between the button end of the lever and the knife handle, thereby creating a risk that a foreign object could enter this gap and prevent the user from flexing the lever to withdraw the knife. Additionally, this design cannot be used with a knife having a finger guard on both sides of the knife because such an arrangement would interfere with the lever/band locking mechanism.

Reference is also made here to Tracy, U.S. Pat. No. 4,150,464 issued Apr. 24, 1979 and Frano/Keller, U.S. Pat. No. 5,222,279 issued Jun. 29, 1993. Both of these designs provide buckles comprising separate receptacle and clasp/latch members. Though neither the Tracy nor the Frano/Keller design is a knife/sheath locking device, the latch mechanism of the present invention is similar to these two designs. However, Tracy and Frano/Keller are specifically limited to providing buckles and are therefore distinct from the present invention. Additionally, the present invention provides a knife handle in place of the female receptacle member of Tracy and Frano/Keller. Finally, the present invention provides a sheath in place of the clasp or latch member used in Tracy and Frano/Keller.

OBJECTS AND ADVANTAGES

Accordingly, it is an object of the present invention to provide a knife and sheath combination that is simple to operate, reliable and durable in design, and capable of holding the knife securely in the sheath under the most extreme conditions while providing a quick and positive release at the appropriate time.

A further object of the present invention is to provide a knife and sheath combination that can be used by either a right-handed or left-handed person with equal ease and with the knife capable of being inserted in the sheath with the blade facing either forward or rearward.

A still further object of the present invention is to provide a knife/sheath combination that has a streamlined shape, substantially free of protuberances that can snag on foreign objects, both while the knife is in the sheath and while the knife is being used.

A still further object of the present invention is to provide a knife and sheath locking mechanism that can be used with a knife design incorporating finger guards on both sides of the knife handle.

A still further object of the present invention is to allow for a knife/sheath locking combination that is compatible with a relatively small knife.

A still further object of the present invention is to provide an improved knife/sheath locking mechanism that can be economically manufactured using injection molding production techniques.

Still other objects and advantages of the present invention will become apparent from a consideration of the ensuing description and drawings.

DETAILED DESCRIPTION OF THE INVENTION (PREFERRED EMBODIMENT)—FIGS. 1, 3, AND 7

Figure 1:
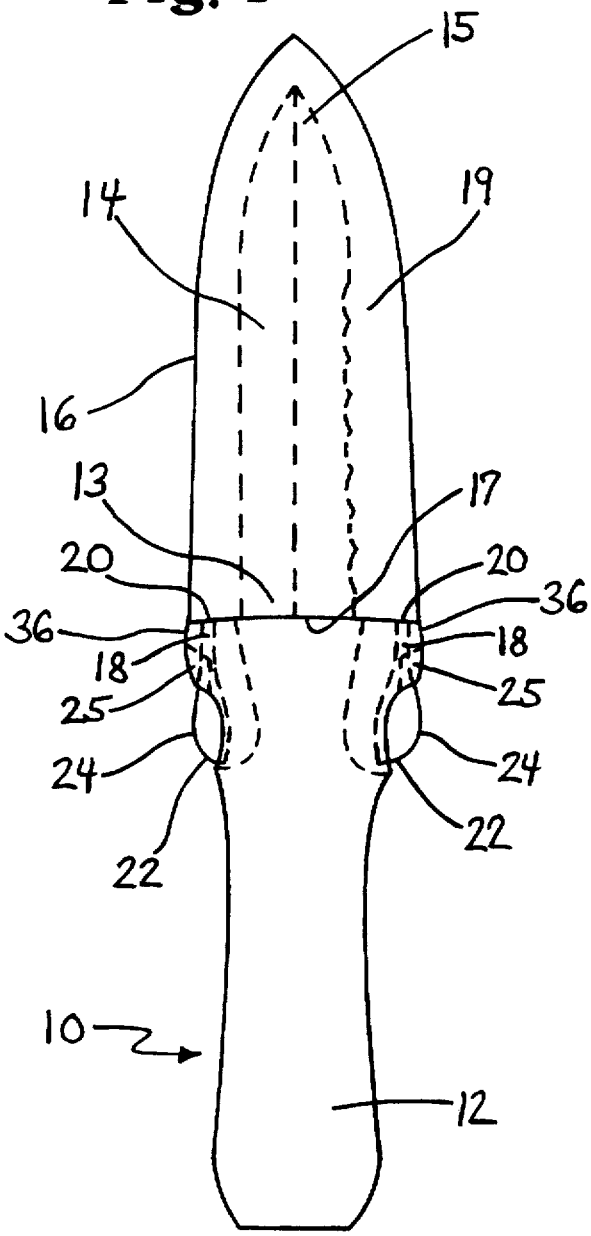
FIG. 1 is an elevational view of the preferred embodiment of the present invention showing the knife secured within the sheath.
Figure 7:
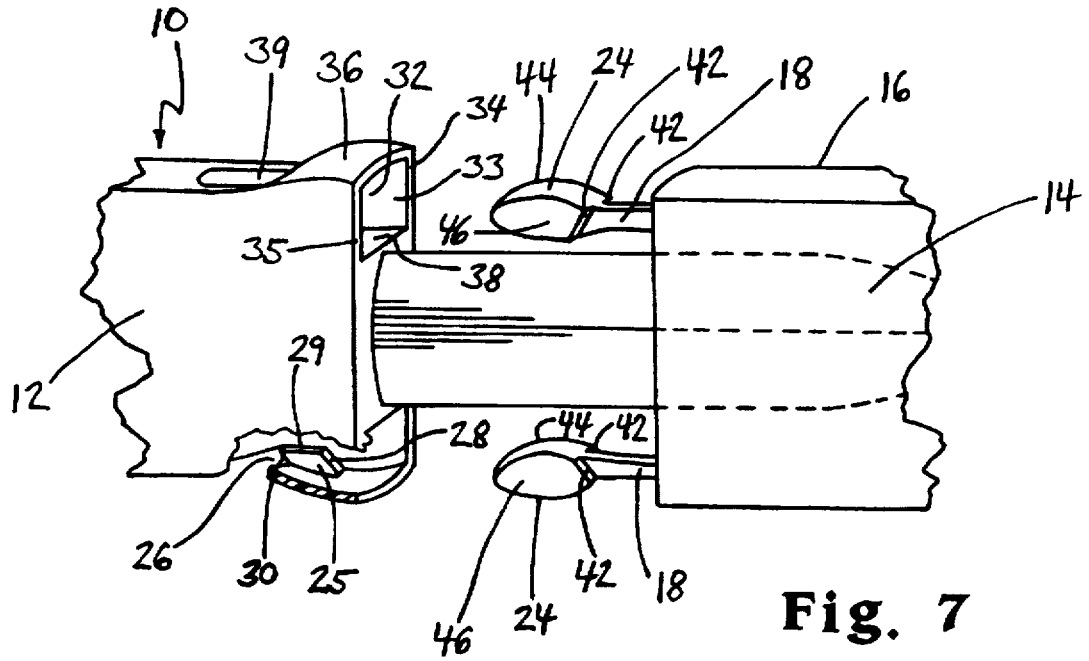
FIG. 7 is a perspective view of a portion of the preferred embodiment showing the locking mechanism uncoupled, the knife partially withdrawn from the sheath, and, in addition, with a portion of the knife handle broken away to reveal the interior engagement members thereof.

The overall arrangement of the preferred embodiment can be best seen in FIGS. 1 and 7. Referring to these drawings, a knife 10 having a handle 12 and a blade 14 is shaped to be secured within a sheath 16. Both the handle 12 and the sheath 16 are preferably molded from a tough resilient plastic material such as nylon. In both the preferred embodiment and the alternative embodiment illustrated, the knife 10 and sheath 16 combination is designed for use by underwater divers or by other users who require an easily accessible knife suitable for situations where the knife may be wholly or partially submerged in water.

The blade 14 has a tip 15 and a base 13. The sheath 16 is formed with a knife encasing portion 19 and an open end 17 into which the blade 14 of the knife 10 is inserted.

The sheath 16 preferably includes two flexible arm members 18 formed on opposite sides of the sheath 16 and extending outward away from the open end 17 of the sheath 16 a predetermined distance. Each flexible arm member 18 includes a first proximal end 20 connected to the sheath 16 and a second opposite distal end 22. In the preferred embodiment, the distal end 22 of each flexible arm member 18 can include a rounded protrusion 24 on its outside surface, the purpose and operation of which will be explained in detail below.

The handle 12 preferably includes two tubular structures or tunnels 32, each with front opening 33 located adjacent to the base 13 of the blade 14 and a rear opening 39 located distal to the blade 14. The tunnels 32 are located on opposite sides of the handle 12 and are each defined by a first surface or top wall 34, a second surface or bottom wall 35, a third surface or outer wall 36, and a fourth surface or tunnel floor 38. The rear openings 39 may take a number of shapes depending upon variations in the configuration of the top walls 34, the bottom walls 35, and the tunnel floors 38.

As will be explained in detail below, the flexible arms 18 of the sheath 16 are received and releasibly retained within the tunnels 32 of the handle 12, thus providing a means for securing the knife 10 within the sheath 16.

In the preferred embodiment, each tunnel 32 includes a pair of engagement members 25 positioned within each tunnel. The engagement members 25 in each pair are formed with one engagement member 25 spanning the intersection of the outer wall 36 and the top wall 34, and the other engagement member spanning the intersection of the outer wall 36 and the bottom wall 35. A gap 26 is provided between the engagement members 25 of each pair for accepting a portion of the flexible arm 18 therebetween.

To guide and retain the flexible arms 18, each engagement member includes a first ramped surface 28, a second sliding surface 29, and a third locking surface 30. The third locking surface of each engagement member 25 is substantially in alignment with the rear opening 39 of the respective tunnel 32.

To releasibly engage the flexible arms 18 of the sheath 16 within the handle 12, each flexible arm 18 includes a shoulder 42 formed on both a top surface 44 and a bottom surface 46 of the flexible arms 18. Preferably, to assist in engagement and prevent premature or inadvertent release of the knife 10 from the sheath 16, the shoulders 42 are formed at an angle for cooperation with a complementary angle of the third locking surfaces 30 of the engagement members 25 as will be described in detail below.

Figure 3:
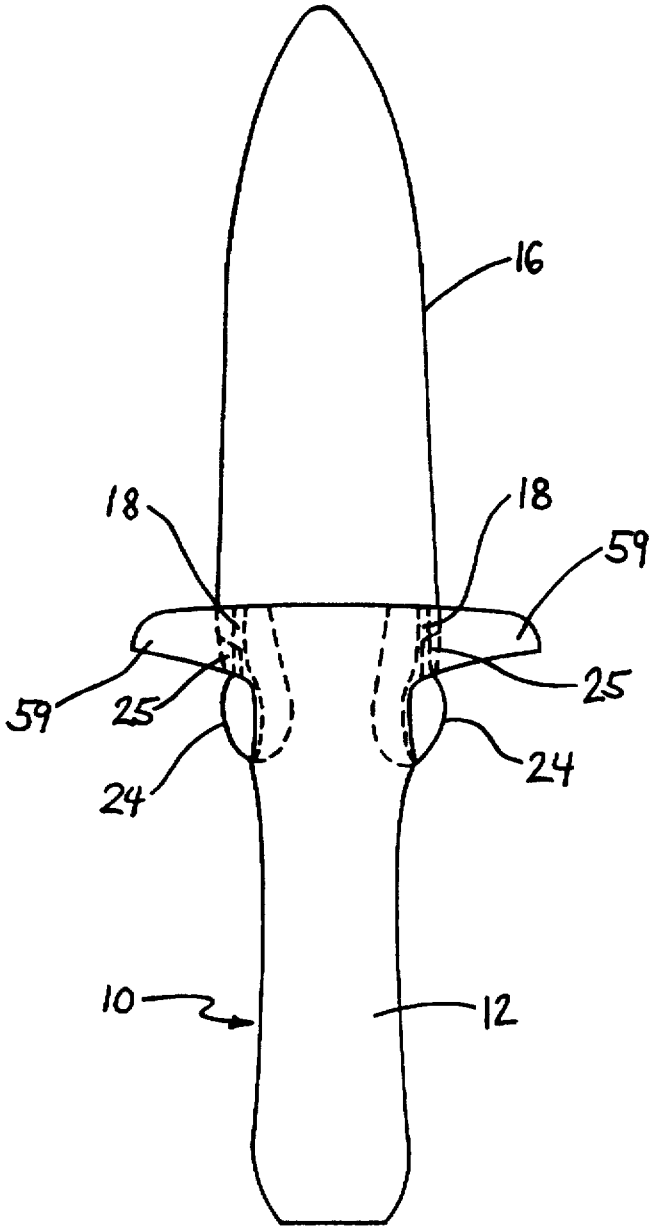
FIG. 3 is an elevational view showing the preferred embodiment in use with a knife having finger guards on both sides of the knife handle.

FIG. 3 shows a version of the preferred embodiment incorporating a finger guard 59 on both sides of the handle 12. If preferred by a user, one of the two finger guards 59 may be omitted. In both instances, however, the basic locking mechanism remains the same.

OPERATION OF THE PREFERRED EMBODIMENT—FIG. 2

As the knife 10 is inserted into the open end 17 of the sheath 16, the handle 12 is moved to a position such that each tunnel 32 is substantially in alignment with a distal end 22 of a flexible arm 18. When the knife 10 is pushed further into the sheath 16, the distal end 22 of each flexible arm 18 will enter the tunnel 32 that is aligned with that particular flexible arm 18. Continuing, the distal ends 22 will then contact the first ramped surfaces 28 of the respective engagement member 25 and the flexible arms 18 will be flexed toward the tunnel floors 38. Further insertion provides for the rounded protrusions 24 to ride along the second sliding surface 29 of the respective engagement member 25 until the rounded protrusions 24 and the shoulders 42 clear the second sliding surfaces 29. At that point, each flexible arm 18 snaps outward with respect to its tunnel floor 38 and, as FIGS. 1 and 3 illustrate, the shoulders 42 are seated against the third locking surface 30 of the respective engagement member 25 and the rounded protrusions 24 extend outward through the rear openings 39.

When the knife 10 is fully inserted into the sheath 16, the open end 17 of the sheath 16 will be substantially flush against that portion of the handle 12 adjacent to the base 13 of the blade 14.

Figure 2:
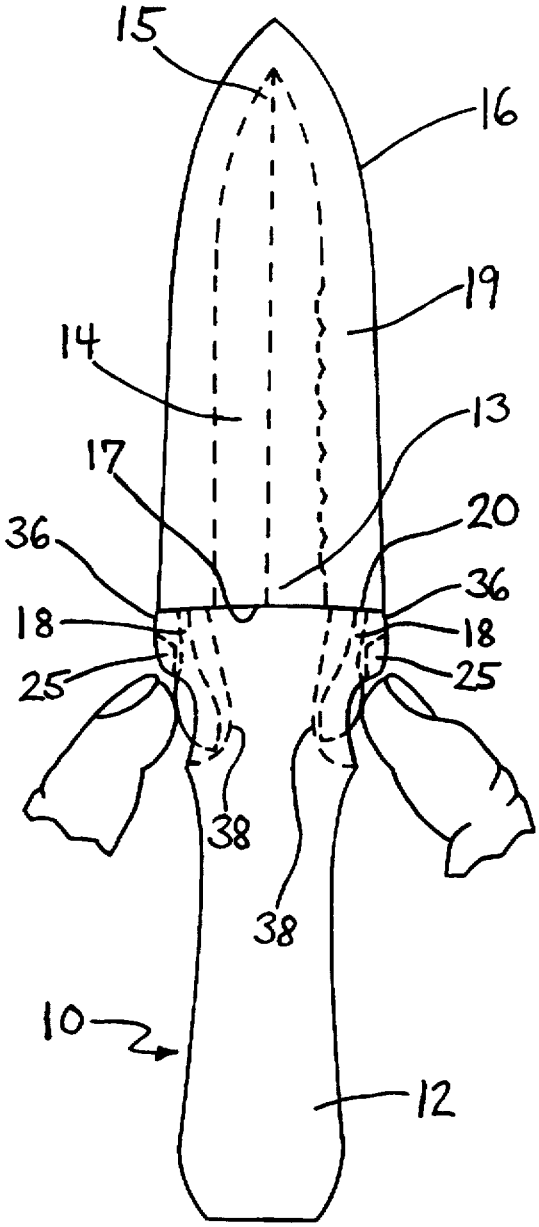
FIG. 2 is an elevational view of the preferred embodiment illustrating the release of the knife from the sheath.

As FIG. 2 illustrates, to release the knife 10 from the sheath 16, a user engages the rounded protrusions 24 and exerts an inward pressure thereon to bend the flexible arms 18 toward the tunnel floors 38. Once the shoulders 42 of the flexible arms 18 clear the third locking surface 30 of the engagement members 25, the knife 10 can be withdrawn from the sheath 16.

DESCRIPTION (ALTERNATIVE EMBODIMENT)—FIGS. 4, 5, AND 8

Figure 4:
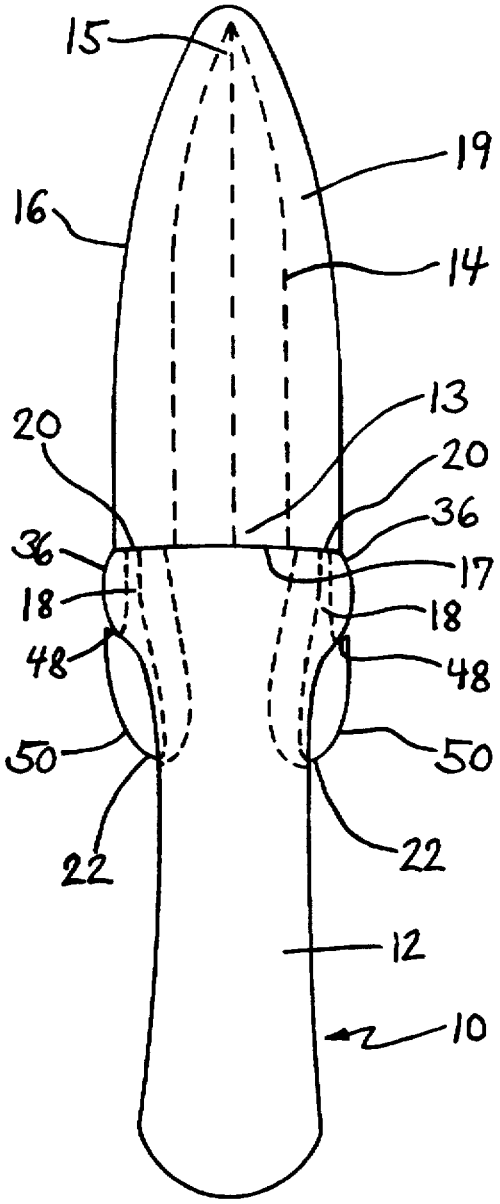
FIG. 4 is an elevational view of the alternative embodiment of the present invention showing the knife secured within the sheath.
Figure 8:
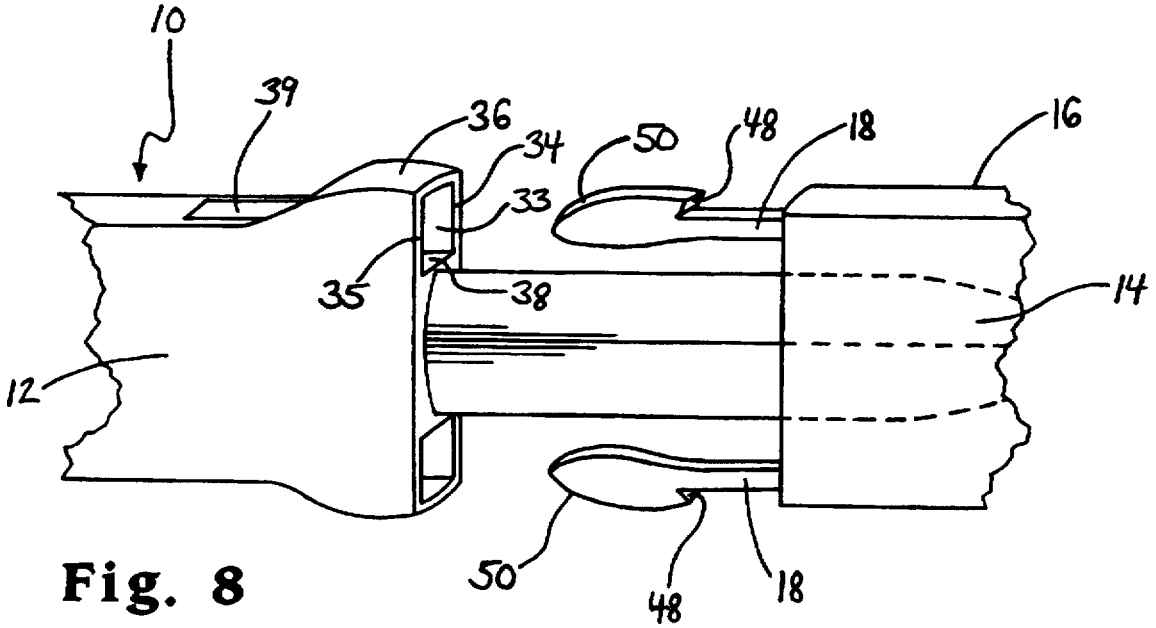
FIG. 8 is a perspective view of a portion of the alternative embodiment showing the locking mechanism uncoupled and the knife partially withdrawn from the sheath.

An alternative embodiment, also claimed in this application, is substantially similar to the above-described preferred embodiment. Referring to FIGS. 4 and 8, in this second embodiment the engagement members 25 are eliminated from the tunnels 32. Additionally, the rounded protrusions 24 are eliminated from the flexible arms 18.

Instead, each flexible arm 18 has a locking tab means comprising a raised edge 48, which locking tabs are spaced apart somewhat in excess of the distance between the outer walls 36 of the tunnels 32. The raised edges 48 decrease in width towards the leading edge thereof to define a pair of ramps 50 thereon. Leading edges of the ramps 50 are spaced apart a distance somewhat less than the distance between the outer walls 36 of the tunnels 32.

Figure 5:
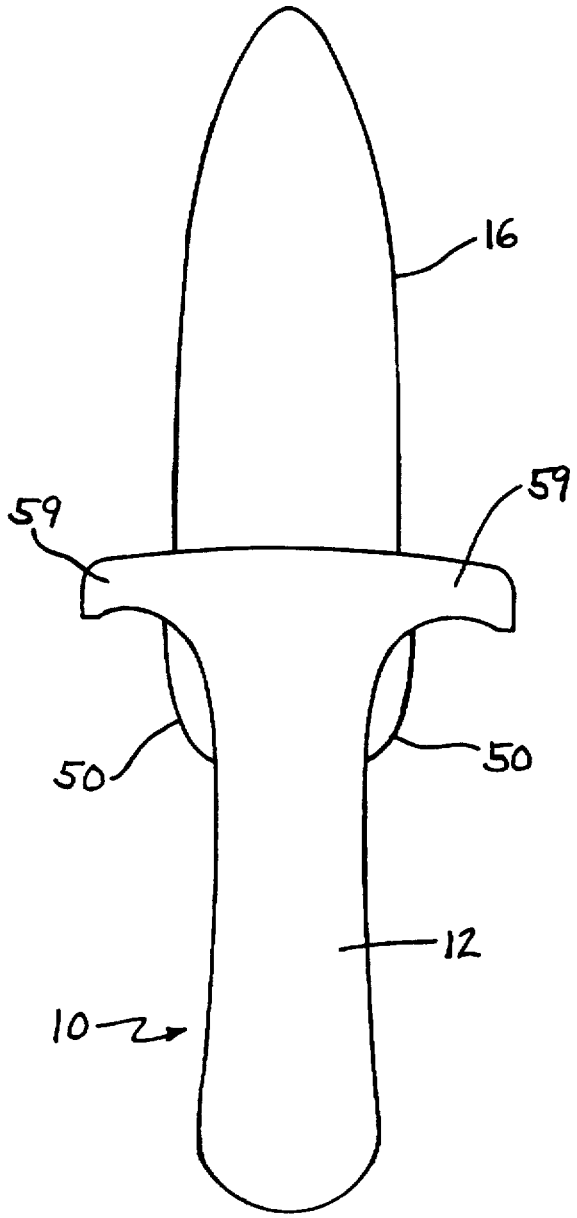
FIG. 5 is an elevational view showing the alternative embodiment in use with a knife having finger guards on both sides of the knife handle.
Figure 6:
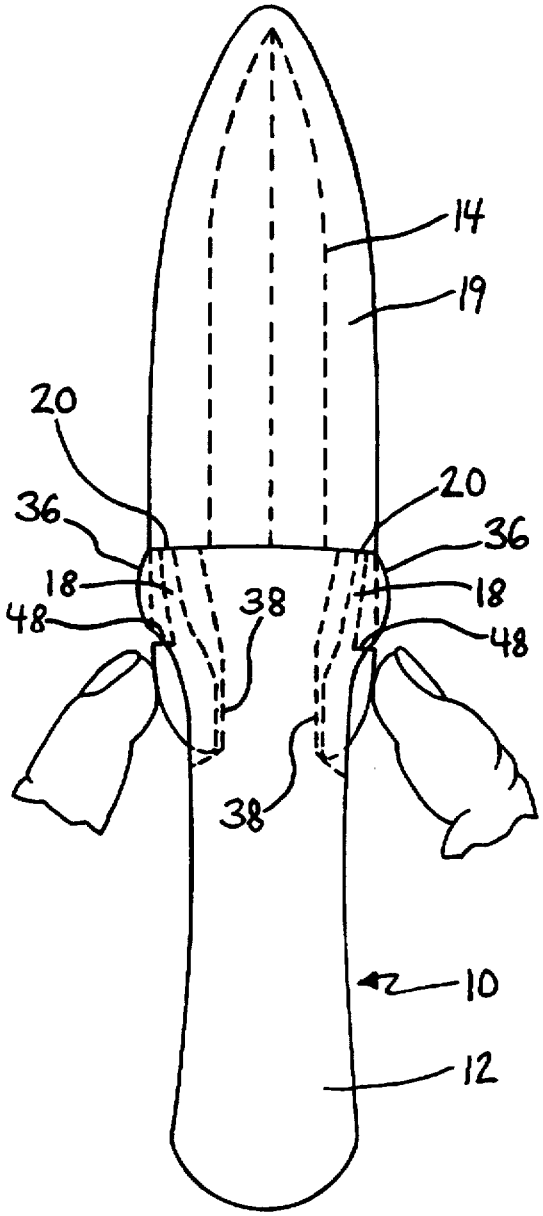
FIG. 6 is an elevational view of the alternative embodiment illustrating the release of the knife from the sheath.

FIG. 5 shows a version of the alternative embodiment with a finger guard 59 on both sides of the handle 12. As with the preferred embodiment, the alternative embodiment can include only one finger guard 59 if a user so desires. In either case the basic locking mechanism remains the same.

OPERATION OF THE ALTERNATIVE EMBODIMENT—FIG. 6

As the knife 10 is inserted into the sheath 16, the leading edges of the ramps 50 slidingly engage the inner sides of the outer walls 36. The flexible arms 18 will then bend inwardly as the knife 10 is inserted further into the sheath 16. As the trailing ends of the raised edges 48 reach the rear openings 39, the flexible arms 18 spring or snap back to their original configuration thereby locking the tabs comprising the raised edges 48 against the rear opening 39 edge of the respective outer wall 36 so as to secure the knife 10 within the sheath 16.

The method of releasing the knife 10 from the sheath 16 is similar to the method used with the previously-described preferred embodiment. Inward pressure upon the flexible arms 18 and particularly at the raised edges 48 results in the flexible arms 18 moving inwardly until the distance between the raised edges 48 is somewhat less than the distance between the outer walls 36 of the tunnels 32, whereby the knife 10 may be readily removed from the sheath 16.

It will be appreciated from the drawings that the preferred embodiment and the alternative embodiment of the present invention differ only slightly in the means by which the flexible arms 18 engage the tunnels 32 and are retained within the handle 12. The preferred embodiment is slightly better suited for aquatic uses because it has a more streamlined profile that reduces the likelihood of a foreign object snagging on the knife 10 and/or sheath 16. The choice between the two embodiments, however, depends upon a user's preference and both designs are claimed in this application.

With respect to both the preferred embodiment and the alternative embodiment, however, the sheath 16 may be constructed in a manner such that it is flared outward at the open end 17 to make it easier for a user to insert the tip 15 of the blade 14 into the sheath 16. The knife encasing portion 19 can then narrow so that it will act to keep the blade 14 in a relatively flat position with respect to the sheath 16, thus helping to align the flexible arms 18 with the tunnels 32 as a user inserts the knife 10 into the sheath 16.

SUMMARY, RAMIFICATIONS, AND SCOPE

Accordingly, both the preferred embodiment and the alternative embodiment provide a knife/sheath locking device that is particularly well-suited for use while in water or underwater. Because it is intended to be manufactured by injection-molding production techniques, both the handle and the sheath of the design can be economically made from a durable, corrosive-resistant material. Furthermore, both embodiments provide secure, accessible latch mechanisms that can be easily operated by users wearing gloves, such as the gloves worn by underwater divers.

The locking mechanism provided by the present invention also has other advantages in that:

it can be used with knives having a variety of blade designs;

it provides a secure locking mechanism suitable for use with knife/sheath combinations of all sizes;

it does not require the manufacture and assembly of a number of component parts.

While the above description contains many specificities, these should not be construed as limiting the scope of the invention, but rather as an exemplification of the preferred embodiments thereof.

Accordingly, the scope of the invention should be determined not by the embodiments illustrated, but by the appended claims and their legal equivalents.

I claim:

1. A knife/sheath combination, comprising:

a sheath, said sheath having a knife encasing portion and an open end;

a knife to be inserted into said sheath, said knife having a blade and a handle;

said handle having at least one tunnel structure located proximal to said blade of said knife, said tunnel structure being defined by a top wall, a bottom wall, and an outer wall, said tunnel structure having a front opening and a rear opening, and said tunnel structure incorporating latch-retaining means;

said sheath including at least one flexible arm extending outward from said open end in a direction toward said handle of said knife when said blade of said knife is enclosed within said sheath, said flexible arm positioned to be cooperatively accepted by said tunnel structure on said handle, and latch means disposed on said flexible arm for releasable locking engagement with said latch-retaining means of said tunnel structure upon insertion of said flexible arm within said tunnel structure;

said flexible arm and said tunnel structure shaped to provide an inward deflection of said flexible arm with respect to said knife handle upon insertion of said flexible arm within said tunnel structure until the point at which said latch means of said flexible arm engages said latch-retaining means of said tunnel structure, whereupon said flexible arm will flex in a direction outward with respect to said handle to obtain a locked position by the interaction of said latch means with said latch-retaining means.

2. A knife/sheath combination as set forth in claim 1, wherein:

said sheath includes a second said flexible arm located on the opposite side of said sheath as the first said flexible arm; and said handle includes a second said tunnel structure located on the opposite side of said handle as the first said tunnel structure;

said flexible arms and said tunnel structures positioned such that each said flexible arm will be cooperatively accepted within a said tunnel structure as said knife is inserted into said sheath.

3. A knife/sheath combination as set forth in claim 1, wherein:

said latch-retaining means in said tunnel structure is comprised of two engagement members, one said engagement member formed to span the intersection of said outer wall and said top wall of said tunnel structure, and the other said engagement member formed to span the intersection of said outer wall and said bottom wall of said tunnel structure;

said latch means on said flexible arm comprising a shoulder proximate a distal end of said flexible arm and said shoulder extending laterally on opposite sides of said flexible arm;

said engagement member providing the inward deflection of said flexible arm upon insertion of said flexible arm within said tunnel structure until said flexible arm clears said engagement members and flexes outward to reach the locked position.

4. A knife/sheath combination as set forth in claim 1, wherein:

said latch-retaining means is comprised of a pair of engagement members located within said tunnel structure, each said engagement member including a locking surface formed so that said locking surface is substantially flush with said rear opening of said tunnel structure, thus allowing the distal end of said flexible arm to protrude from said rear opening of said tunnel structure when said knife is in the locked position within said sheath.

5. A knife/sheath combination as set forth in claim 1, wherein:

the portion of said outer wall adjacent to said rear opening of said tunnel structure comprises said latch-retaining means, and said latch means is comprised of a raised edge portion at the leading end of said flexible arm, said raised edge portion extending outward beyond said outer wall of said tunnel structure such that upon insertion of said flexible arm within said tunnel structure said raised edge portion engages said outer wall at said rear opening thus retaining said knife within said sheath.

6. A knife/sheath combination as set forth in claim 1, wherein:

the portion of said outer wall adjacent to said rear opening of said tunnel structure comprises said latch-retaining means, and said latch means is comprised of a raised edge portion at the leading end of said flexible arm, said raised edge portion extending outward beyond said outer wall of said tunnel structure such that upon insertion of said flexible arm within said tunnel structure said raised edge portion engages said outer wall at said rear opening thus retaining said knife within said sheath;

said leading end of said flexible arm including a ramp surface that provides the inward deflection of said flexible arm as said flexible arm is inserted into said tunnel structure until the point at which said raised edge portion clears the rear opening of said tunnel structure, whereupon said flexible arm will flex back to its original position.

* * * * *